US007775948B2

(12) United States Patent
Chen

(10) Patent No.: US 7,775,948 B2
(45) Date of Patent: Aug. 17, 2010

(54) DUMBBELL STRUCTURE

(76) Inventor: Hung-Lung Chen, No. 5-12, Sheling, Neighborhood 1, Sheling Village, Yuanli Township, Miaoli County 358 (TW)

( * ) Notice: Subject to any disclaimer, the term of this patent is extended or adjusted under 35 U.S.C. 154(b) by 0 days.

(21) Appl. No.: 11/984,581

(22) Filed: Nov. 20, 2007

(65) Prior Publication Data

US 2009/0131232 A1 May 21, 2009

(51) Int. Cl.
*A63B 21/072* (2006.01)

(52) U.S. Cl. ..... 482/108; 482/106

(58) Field of Classification Search ..... 482/93, 482/106–109

See application file for complete search history.

(56) References Cited

U.S. PATENT DOCUMENTS 4,787,629 A * 11/1988 DeMyer ..... 482/107
4,948,123 A * 8/1990 Schook ..... 482/107
5,605,411 A * 2/1997 Wilson et al. ..... 403/325
5,697,871 A * 12/1997 Landfair ..... 482/82
7,048,678 B2 * 5/2006 Harms et al. ..... 482/107
7,083,553 B2 * 8/2006 Leon ..... 482/106
2007/0249475 A1 * 10/2007 Cao ..... 482/107

* cited by examiner

*Primary Examiner*—Fenn C Mathew
(74) *Attorney, Agent, or Firm*—Muncy, Geissler, Olds & Lowe, PLLC

(57) ABSTRACT

The present invention relates to an improved dumbbell structure, in which a clamping portion, used for mounting weights, is located on two ends of a hand grip of a dumbbell. A clamping hole, a press operation recess and a fixing hole are defined on each of the clamping portions, and a clamping column is located within each of the clamping holes. A press operation column is disposed within each of the press operation recesses. When force is applied to the press operation column, then the press operation column exerts force on the clamping column, and causes the clamping column to separate from the weight. Accordingly, a user is able to quickly change weights on the dumbbell.

6 Claims, 9 Drawing Sheets

DUMBBELL STRUCTURE

BACKGROUND OF THE INVENTION (a) Field of the Invention

The present invention provides an improved dumbbell structure, and more particularly provides a dumbbell structure with an improved structure that enables quick changing of weights and easy assembly.

(b) Description of the Prior Art

Physical fitness activities have already become one of the common leisure activities engaged in by the general public, and apart from forging a strong body, keeping fit can also sculpt a muscular physique. However, because of the usually bulky size and expensive cost of fitness equipment, thus, the general public normally goes to a health club to keep fit. Nevertheless, not every person has the time and the money to spend at a health club, and inasmuch as dumbbells can be easily purchased because of the reasonable market price, thus, the general public will usually purchase dumbbells for use at home. And using the simple dumbbell enables achieving weight training of multiple parts of the body through frequent physical exercise. Accordingly, the dumbbell has become one of the most popular fitness equipment used by the general public.

However, although use of the dumbbell is widespread, nonetheless, because the objective of physical exercise of each exerciser and physical ability is different, thus, different exercisers frequently require different weights and often need to choose and match different weights. Hence, the weights are repeatedly changed; different weights being used during and after warm up or different exercisers requiring different weights. Accordingly, complicated and time-consuming changing of the weights results in inconvenience for people when using the dumbbells.

When using the aforementioned dumbbells of the prior art, the following problems and shortcomings clearly exist and await improvement:

the dumbbell of prior art is structured from a hand bar and weights on two ends thereof with the addition of two cap nuts. When a user wants to change the weights, the end cap nuts must be first slowly unscrewed from the screw threads on the hand bar, after which the weights are taken off, and one of the substitute weights is placed on one end of the hand bar, and the cap nut slowly screwed back onto the hand bar, after which the procedure is repeated on the other end of the hand bar.

Hence, it is the strong desire of the inventor and manufacturers engaged in related art and purpose of the present invention to resolve and surmount existent technical difficulties to eliminate the problems and shortcomings of the aforementioned prior art.

SUMMARY OF THE INVENTION

Accordingly, in light of the shortcomings of the aforementioned prior art, the inventor of the present invention, having collected related data, and through evaluation and consideration from many aspects, as well as having accumulated years of experience in related arts, through continuous testing and improvements has designed a new improved dumbbell structure of the present invention.

A primary objective of the present invention is to provide a dumbbell comprising a hand grip, weights and press operation pieces, wherein each of the weights is configured with a hole provided with a clamping groove. Moreover, a clamping portion is located on two ends of the hand grip, and perpendicularly displaced clamping holes and fixing holes are defined on each of the clamping portions. An end surface of each of the clamping portions is configured with a press operation recess, and a clamping column is located within each of the clamping holes. A spring is mounted on an end of each of the clamping columns, and a clamping end is located at the other end. Moreover, the center section of each of the clamping columns is configured with an actuating groove. A press operation column is disposed within each of the press operation recesses; a spring is mounted on an end of each of the press operation column, and a press operation end is located on the other end. Center sections of the press operation columns are respectively configured with a locating hole, and a fixing pin is disposed within each of the fixing holes and penetrates the respective locating holes of the press operation columns, thereby preventing the press operation column from dropping out of the press operation recess and restricting movement range of the press operation column. When force is applied to the press operation column using the press operation piece, then the press operation end of the press operation column exerts force on the actuating groove of the clamping column, thereby causing the clamping end of the clamping column to separate from the clamping groove within the weight. When the general user wants to change the weights, merely respectively using the press operation piece to press down on the press operation column enables the weight to be taken off; and when putting on the weights, merely respectively joining the clamping portion into the hole of the weight enables the clamping end of the clamping column to enter the clamping groove, thereby enabling weights of different weight to be put onto the hand grip, and achieving the objective of quick changing of the weights.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
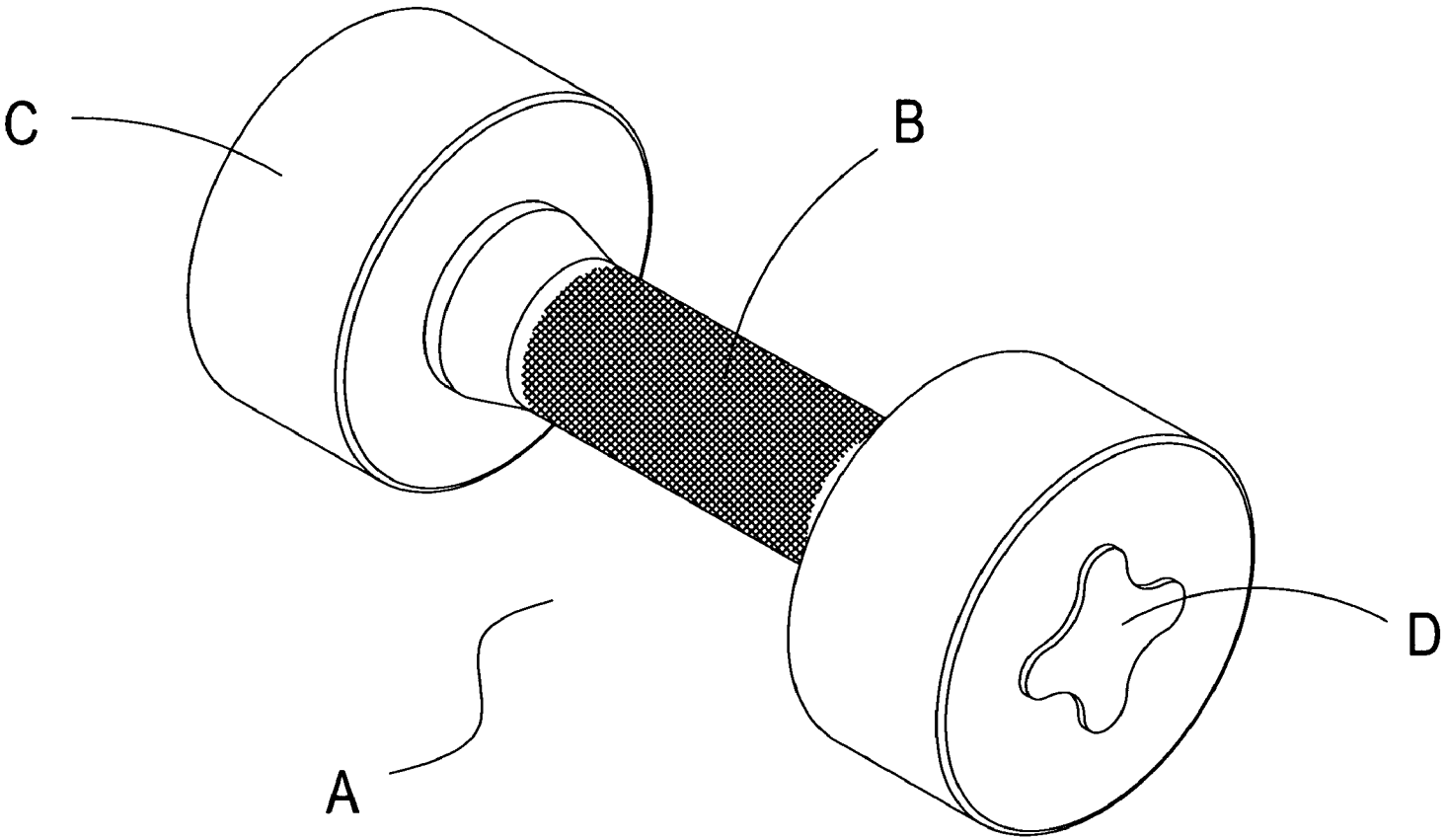
FIG. 1 shows an elevational view of a preferred embodiment according to the present invention.
Figure 2:
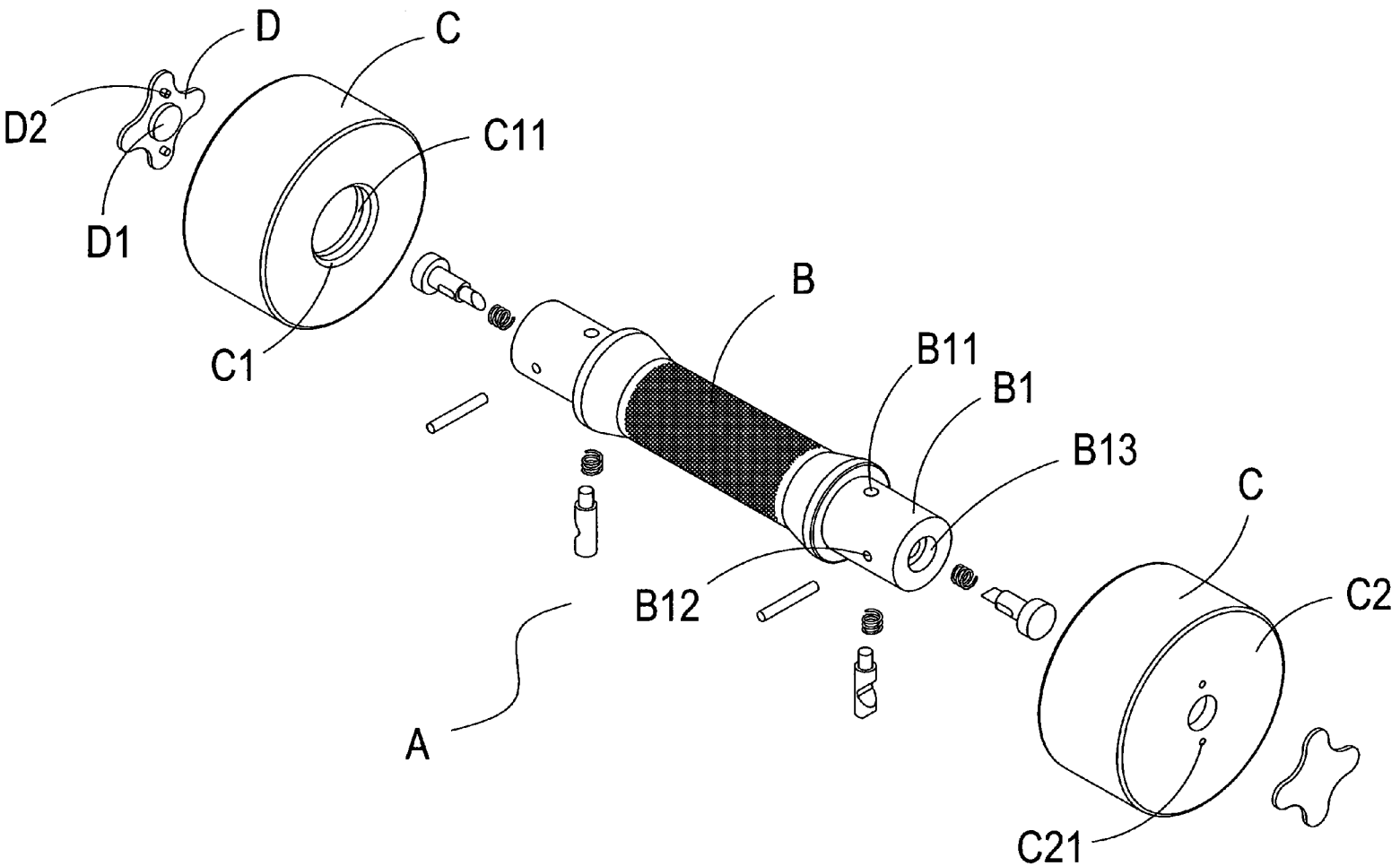
FIG. 2 shows an exploded elevational view of the preferred embodiment according to the present invention.
Figure 3:
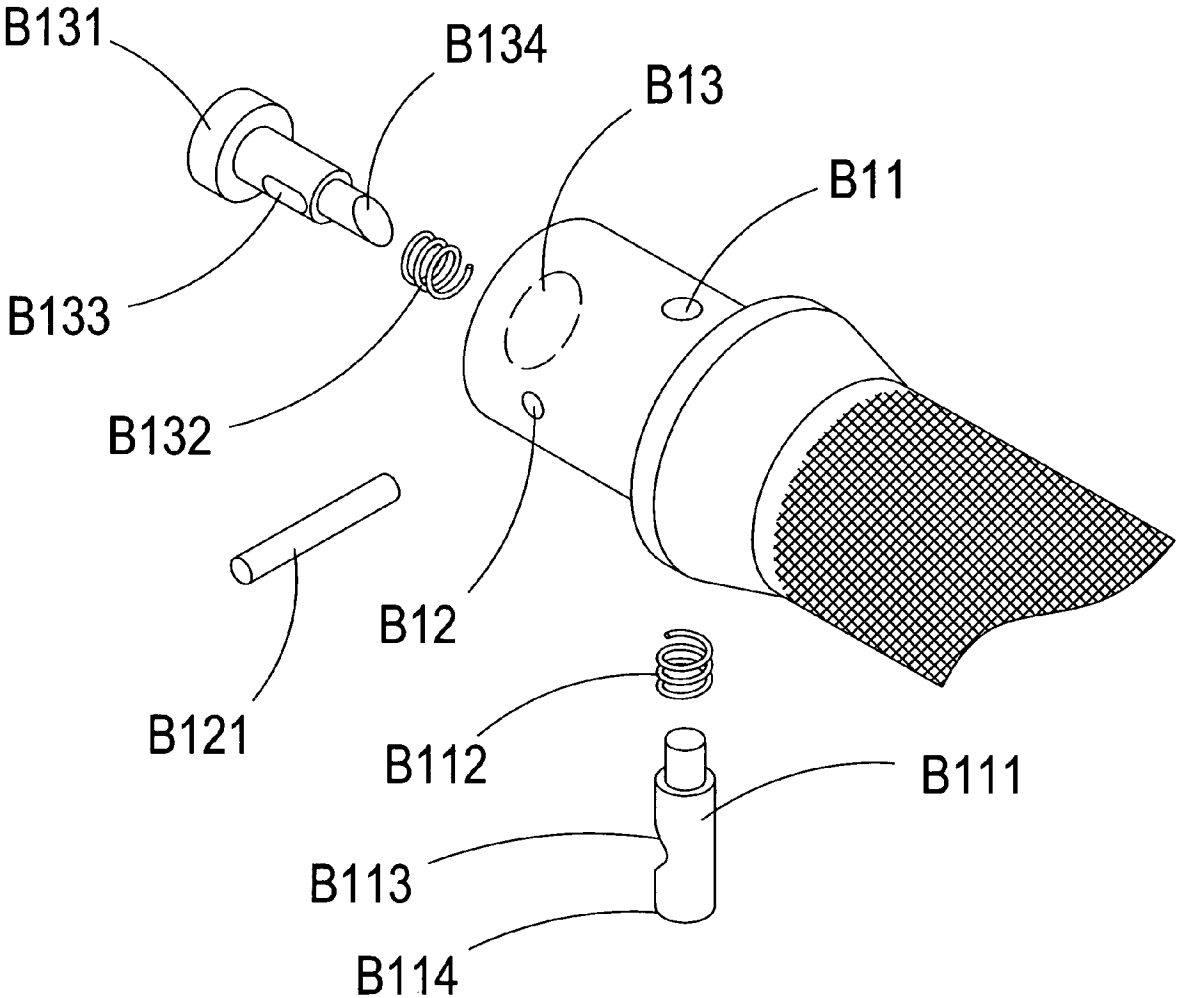
FIG. 3 shows a partial exploded elevational view of the preferred embodiment according to the present invention.
Figure 4:
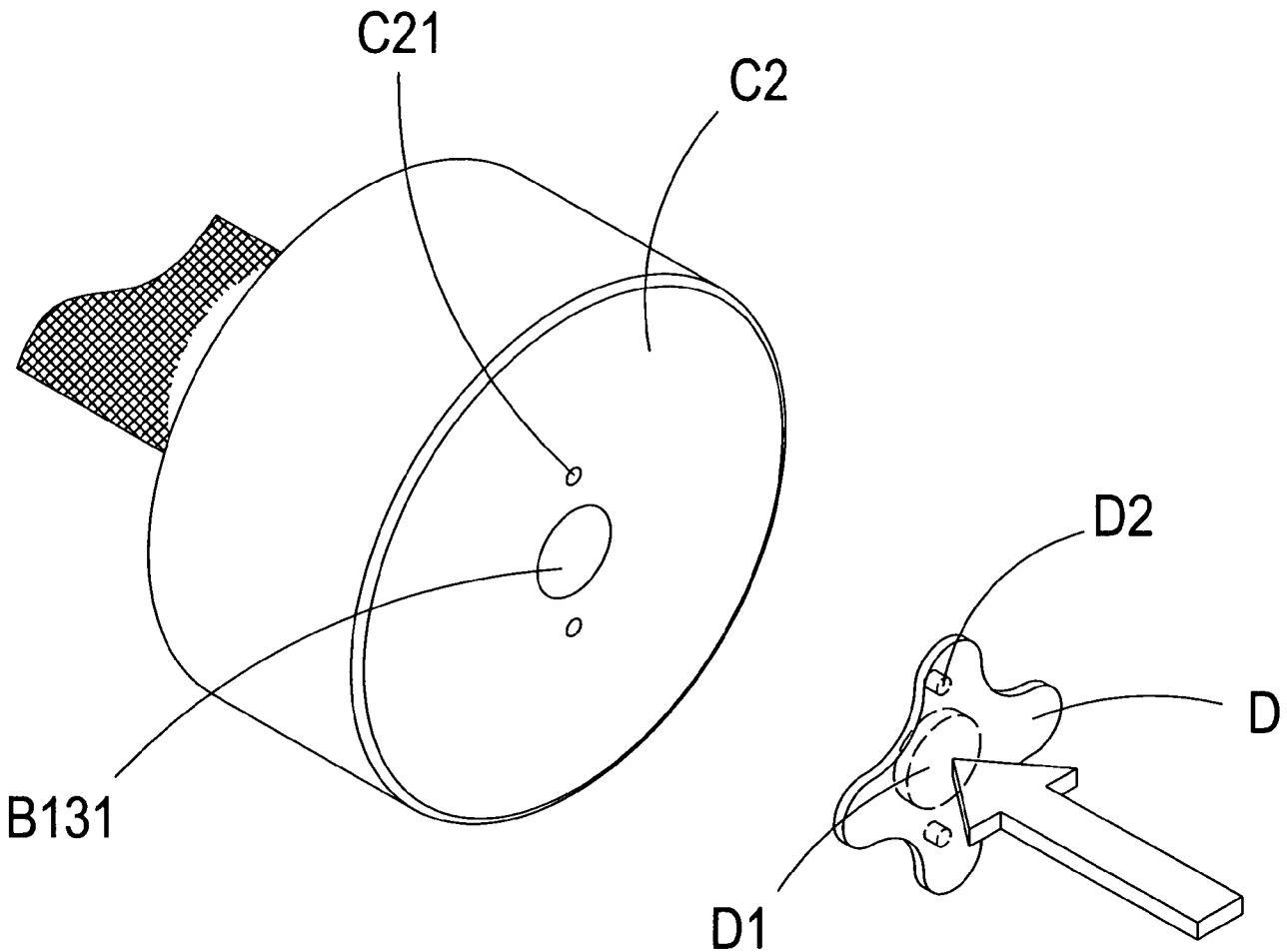
FIG. 4 shows a schematic view 1 of the preferred embodiment according to the present invention.
Figure 5:
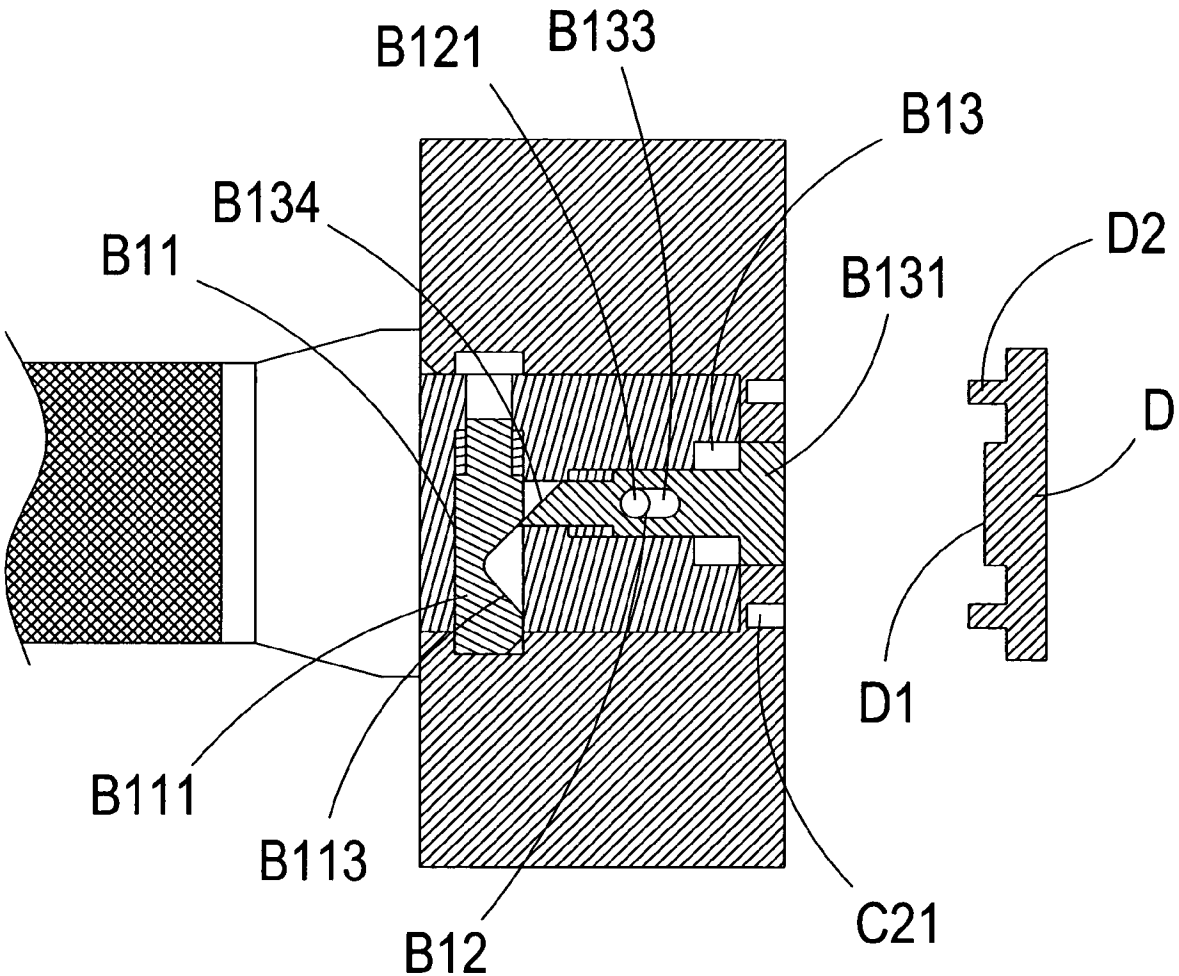
FIG. 5 shows a sectional view 1 of the preferred embodiment according to the present invention.
Figure 6:
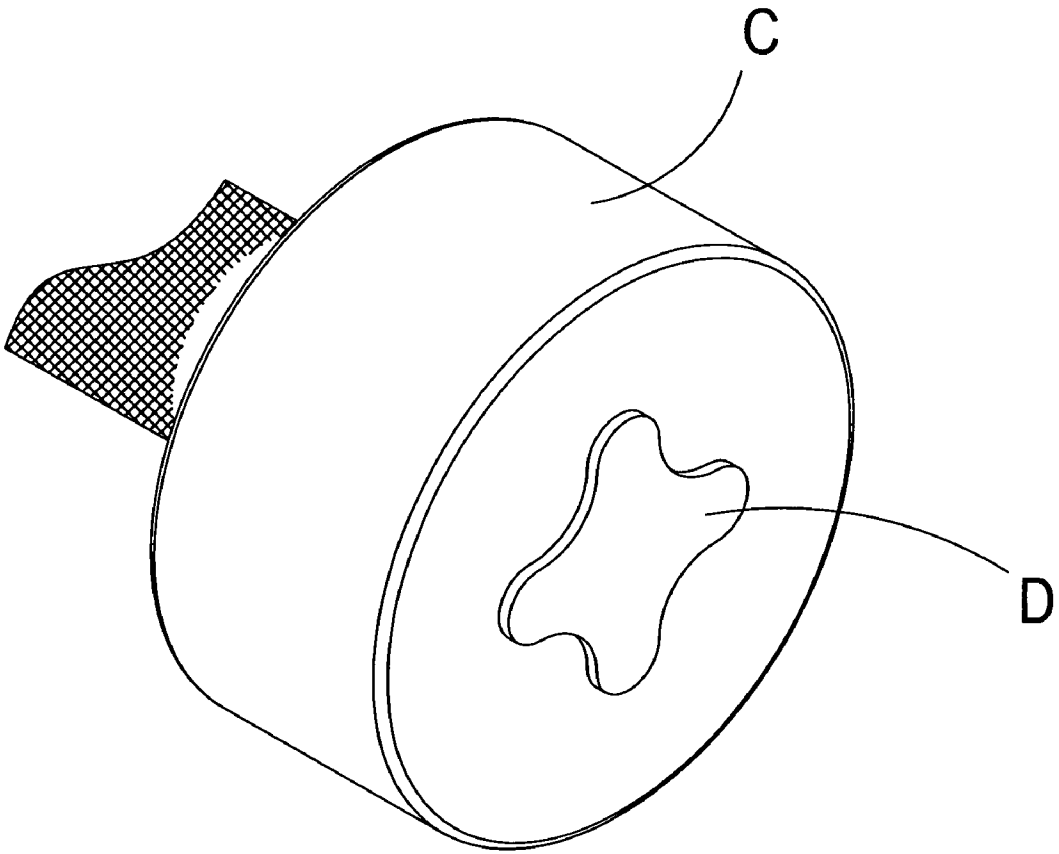
FIG. 6 shows a schematic view 2 of the preferred embodiment according to the present invention.
Figure 7:
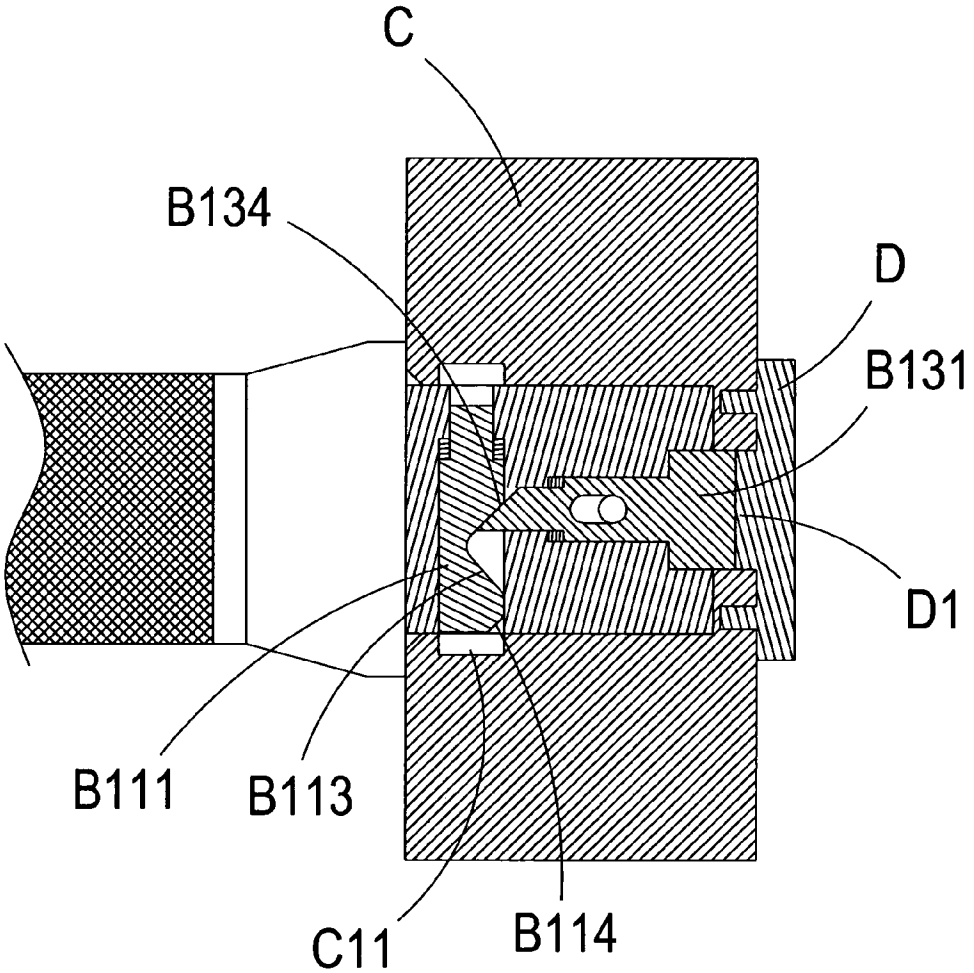
FIG. 7 shows a sectional view 2 of the preferred embodiment according to the present invention.

Referring to FIGS. 1, 2 and 3, which show an external elevational view, an exploded elevational view and a partial exploded view respectively of a preferred embodiment of the present invention, and it can be clearly seen from the drawings that the structure of a dumbbell A comprises a hand grip B, weights C and press operation pieces D. A clamping portion B1 is located on two ends of the hand grip B, and side walls of the clamping portions B1 are respectively configured with clamping holes B11, and clamping columns B111 are respectively located within the clamping holes B11. A spring B112 is mounted on an end of each of the clamping columns B111, and a clamping end B114 is located at the other end. Moreover, the center section of each of the clamping columns B111 is configured with an actuating groove B113. Fixing holes B12 are defined in another side wall of the clamping portions B1 perpendicularly displaced from the clamping holes B11, and a fixing pin B121 is disposed within each of the fixing holes B12. Furthermore, end surfaces of the clamping portions B1 are respectively configured with a press operation recess B13, within which is disposed a press operation column B131. A second spring B132 is mounted on an end of each of the press operation columns B131, and a press operation end B134 is located on the other end. Center sections of the press operation columns B131 are respectively configured with a locating hole B133 corresponding to the respective fixing holes B12, and the fixing pins B121 respectively penetrate the locating holes B133. Furthermore, a hole C1 is defined in a side of each of the weights C, and a clamping groove C11 is configured within each of the holes C1, while the other side of each of the weights C is configured with a press fit surface C2. Moreover, each of the press fit surfaces C2 is configured with a plurality of recesses C21. Each of the press operation pieces D is configured with a press portion D1 and a plurality of protruding portions D2. The press portion D1 is located on one side of each of the press operation pieces D, and the plurality of protruding portions D2 are located on the same side as the press portion D1 but protrude out more form the surface compared to the press portion D1. Each of the protruding portions D2 corresponds to the respective recess C21 to provide a position fixing function therein.

According to the aforementioned structure and assembly, operational use of the present invention is described as follows. Referring to FIGS. 4, 5, 6 and 7, which show a schematic view 1, a sectional drawing 1, a schematic view 2 and a sectional drawing 2 respectively of the preferred embodiment of the present invention, and it can be clearly seen from the drawings that when the press operation piece D is pressed onto the press fit surface C2 and the end of the press operation column B131, then each of the protruding portions D2 on the press operation piece D first clamp into the respective recesses C21 to fix position therein, after which force applied to the press operation piece D causes the press portion D1 to inwardly press the end of the press operation column B131. Moreover, the fixing pin B121 within the fixing hole B12 penetrates the locating hole B133 of the press operation column B131, thereby preventing the press operation column B131 from sliding out of the press operation recess B13 and restricting movement range of the press operation column B131. Furthermore, the press operation end B134 of the press operation column B131 is retained within the actuating groove B113 of the clamping column B111, thereby preventing the clamping column B111 from dropping out of the clamping hole B11.

Referring again to FIGS. 6 and 7, which show the schematic view 2 and the sectional drawing 2 respectively of the preferred embodiment of the present invention, and it can be clearly seen from the drawings that when the press portion D1 of the press operation piece D presses the press operation column B131, then the press operation end B134 at the end of the press operation column B131 exerts force on the actuating groove B113 of the clamping column B111, thereby causing the clamping end B114 of the clamping column B111 to separate from the clamping groove C11 of the weight C.

Figure 8:
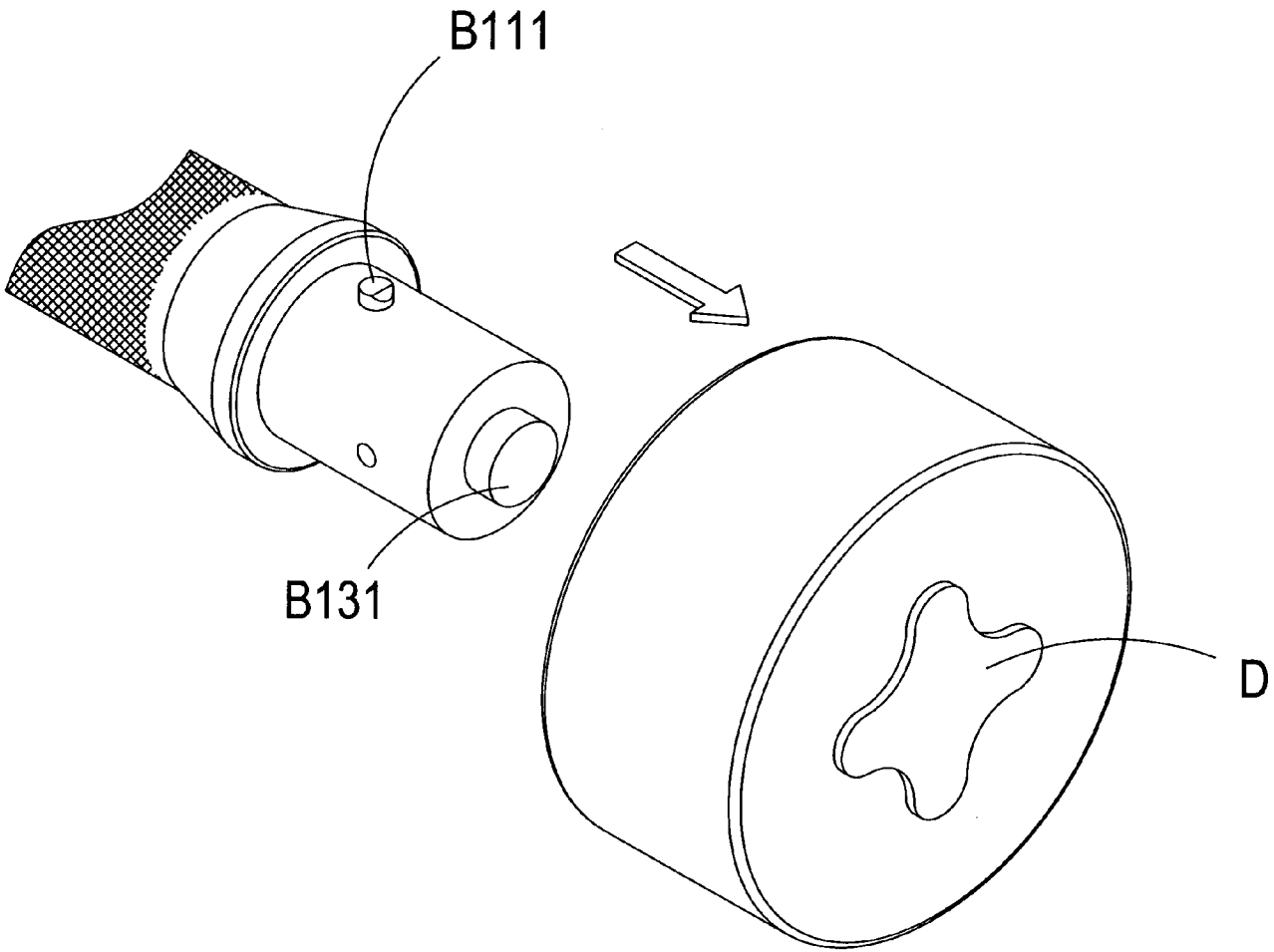
FIG. 8 shows a schematic view 3 of the preferred embodiment according to the present invention.
Figure 9:
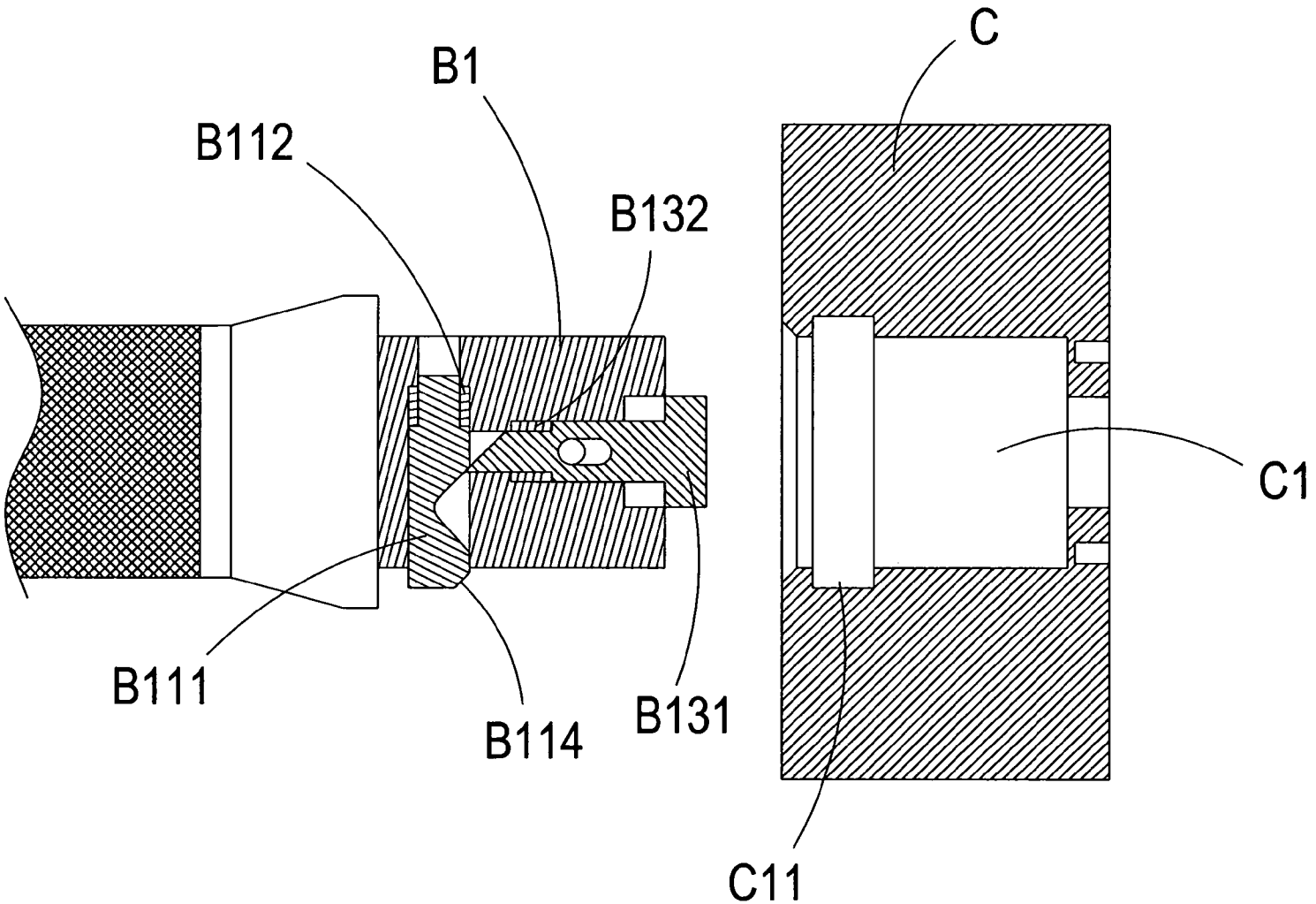
FIG. 9 shows a sectional view 3 of the preferred embodiment according to the present invention.

Referring to FIGS. 8 and 9, which show a schematic view 3 and a sectional drawing 3 respectively of the preferred embodiment of the present invention, and it can be clearly seen from the drawings that when the press operation piece D separates from the end of the press operation column B131, then the elastic force of the second spring B132 causes the press operation column B131 to recoil back to its original position, and elastic force of the first spring B112 causes the clamping column B111 to recoil back to its original position. Furthermore, when wanting to change the weight C with another weight C, then the clamping portion B1 need only be disposed within the hole C1 of the weight C, whereupon the clamping end B114 of the clamping column B111 is used to enable the clamping portion B1 to slip onto the weight C.

Referring to all the drawings, when in use, the present invention has the following advantages compared to the prior art:

1. When wanting to take off the weight C from the dumbbell A, then the press operation piece D need only be used to apply force to the press operation column B131, whereupon the press portion D1 on the press operation piece D presses the press operation column B131, at which time the press operation end B134 of the press operation column B131 exerts force on the actuating groove B113 of the clamping column B111 causing the clamping end B114 of the clamping column B111 to separate from the clamping groove C11. Hence, merely using the aforementioned simple operational structure enables the weights C to be quickly taken off.

2. When wanting to change the weights C with other weights C, by merely using the bevel edged clamping end B114 provided on the clamping column B111, the clamping portions B1 can be respectively slid into the holes C1 of the weights C, thereby enabling quick changing with other weights C.

In conclusion, the improved dumbbell structure of the present invention is clearly able to achieve effectiveness and objectives when in use, and is indeed a practical and exceptional invention that complies with the essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A dumbbell structure, comprising:

a hand grip, a clamping portion is located on two ends of the hand grip, a penetrating clamping hole is defined on each of the clamping portions, and a clamping column is respectively located within each of the clamping holes, an end surface of each of the clamping portions is configured with a press operation recess, and a pressure operation column is located within each of the press operation recesses;

weights, a penetrating hole is defined in each of the weights, and a clamping groove is configured within each of the holes, the clamping portions and the press operation columns are able to be respectively disposed therein;

press operation pieces, the press operation pieces are respectively configured with a press portion able to press the press operation column, wherein a spring is mounted on one end of each of the clamping columns and a clamping end is located at the other end, the center section of the clamping column is configured with an actuating groove.

2. The dumbbell structure according to claim 1, wherein a spring is mounted on one end of each of the press operation columns and a press operation end is located at the other end the center section of the press operation column is configured with a penetrating locating hole.

3. The dumbbell structure according to claim 1, wherein a fixing hole is defined in each of the clamping portions perpendicularly displaced from the clamping hole, and a fixing pin is disposed within the fixing hole.

4. The dumbbell structure according to claims 2, wherein the fixing pins respectively penetrate the locating holes.

5. The dumbbell structure according to claims 3, wherein the fixing pins respectively penetrate the locating holes.

6. The dumbbell structure according to claim 1, wherein a plurality of protruding portions are located on the press operation piece on the same side as the press portion, and a plurality of recesses are defined in one side of each of the weights corresponding to the protruding portions.

* * * * *